US011602254B2

(12) United States Patent
Brugora

(10) Patent No.: US 11,602,254 B2
(45) Date of Patent: Mar. 14, 2023

(54) CLEANING DEVICE

(71) Applicant: Carl Freudenberg KG, Weinheim (DE)

(72) Inventor: Alessandro Brugora, Cernusco sul Naviglio (IT)

(73) Assignee: CARL FREUDENBERG KG, Weinheim (DE)

( * ) Notice: Subject to any disclaimer, the term of this patent is extended or adjusted under 35 U.S.C. 154(b) by 363 days.

(21) Appl. No.: 16/765,512

(22) PCT Filed: Nov. 14, 2018

(86) PCT No.: PCT/EP2018/081212
§ 371 (c)(1),
(2) Date: May 20, 2020

(87) PCT Pub. No.: WO2019/101595
PCT Pub. Date: May 31, 2019

(65) Prior Publication Data

US 2020/0305673 A1 Oct. 1, 2020

(30) Foreign Application Priority Data

Nov. 24, 2017 (EP) ..... 17203440

(51) Int. Cl.
*A47L 11/40* (2006.01)
*B08B 3/02* (2006.01)
*A47L 13/22* (2006.01)

(52) U.S. Cl.
CPC ..... *A47L 11/4086* (2013.01); *B08B 3/02* (2013.01); *A47L 13/225* (2013.01); *B08B 2230/01* (2013.01)

(58) Field of Classification Search
CPC ..... A47L 11/4086
See application file for complete search history.

(56) References Cited

U.S. PATENT DOCUMENTS

| | | | |
|---|---|---|---|
| 2014/0093225 | A1 | 4/2014 | Ashton |
| 2016/0150938 | A1 | 6/2016 | Grove |

FOREIGN PATENT DOCUMENTS

| | | | |
|---|---|---|---|
| CN | 104545712 | A | 4/2015 |
| EP | 3009060 | A1 | 4/2016 |
| GB | 2530568 | A | 3/2016 |
| GB | 2545019 | A | 6/2017 |
| RU | 2502015 | C2 | 12/2013 |
| WO | WO 2016046554 | A1 | 3/2016 |

*Primary Examiner* — Jason Y Ko
(74) *Attorney, Agent, or Firm* — Leydig, Voit & Mayer, Ltd.

(57) ABSTRACT

A cleaning device includes: a liquid container; a heating element; and a pump for conveying liquid out of the liquid container in a direction of the heating element. The heating element at least partially vaporizes the liquid. The heating element is connected to a cleaning head, from which the vaporized liquid exits. A compensating device is arranged between the pump and the heating element.

14 Claims, 7 Drawing Sheets

CLEANING DEVICE

CROSS-REFERENCE TO PRIOR APPLICATIONS

This application is a U.S. National Phase application under 35 U.S.C. § 371 of International Application No. PCT/EP2018/081212, filed on Nov. 14, 2018, and claims benefit to European Patent Application No. EP 17203440.7, filed on Nov. 24, 2017. The International Application was published in English on May 31, 2019 as WO/2019/101595 under PCT Article 21(2).

FIELD

The invention relates to a cleaning device, comprising a liquid container, a pump for conveying liquid out of the liquid container in the direction of a heating element, wherein the heating element is set up to at least partially vaporize the liquid, wherein the heating element is connected to a cleaning head, from which the vaporized liquid exits.

BACKGROUND

Cleaning devices of this type are also termed steam cleaners and are known for example from WO 2016/046554 A1. A liquid is stored in the liquid container, wherein the liquid is for the most part water, which can be provided with a cleaning additive, if appropriate. The liquid is at least partially vaporized in the heating element, wherein the steam exits from the cleaning head and detaches contaminants on surfaces to be cleaned. The heating element is for the most part constructed as an electrical resistance heater. The energy required for heating is for the most part provided by electrical connection. The pump is actuated by a controller driven by a switch. The switch is arranged in the handle of the cleaning device. The heating element is generally kept at a constant temperature by a circuit. It is possible that the controller operating the pump also operates the heating element.

In the case of the previously known cleaning devices, one problem is that the heating element still heats even after the interruption of the pump, so that steam can also still be created from residual water if this is even no longer desired. If steam continues to exit from the cleaning head for a relatively long time, there is therefore a risk for the user.

SUMMARY

In an embodiment, the present invention provides a cleaning device, comprising: a liquid container; a heating element; and a pump configured to convey liquid out of the liquid container in a direction of the heating element, wherein the heating element is configured to at least partially vaporize the liquid, the heating element being connected to a cleaning head, from which the vaporized liquid exits, and wherein a compensating device is arranged between the pump and the heating element

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIG. 2 shows a cleaning device with a compensating tank, allowing fluid to flow through;

DETAILED DESCRIPTION

Figure 1:
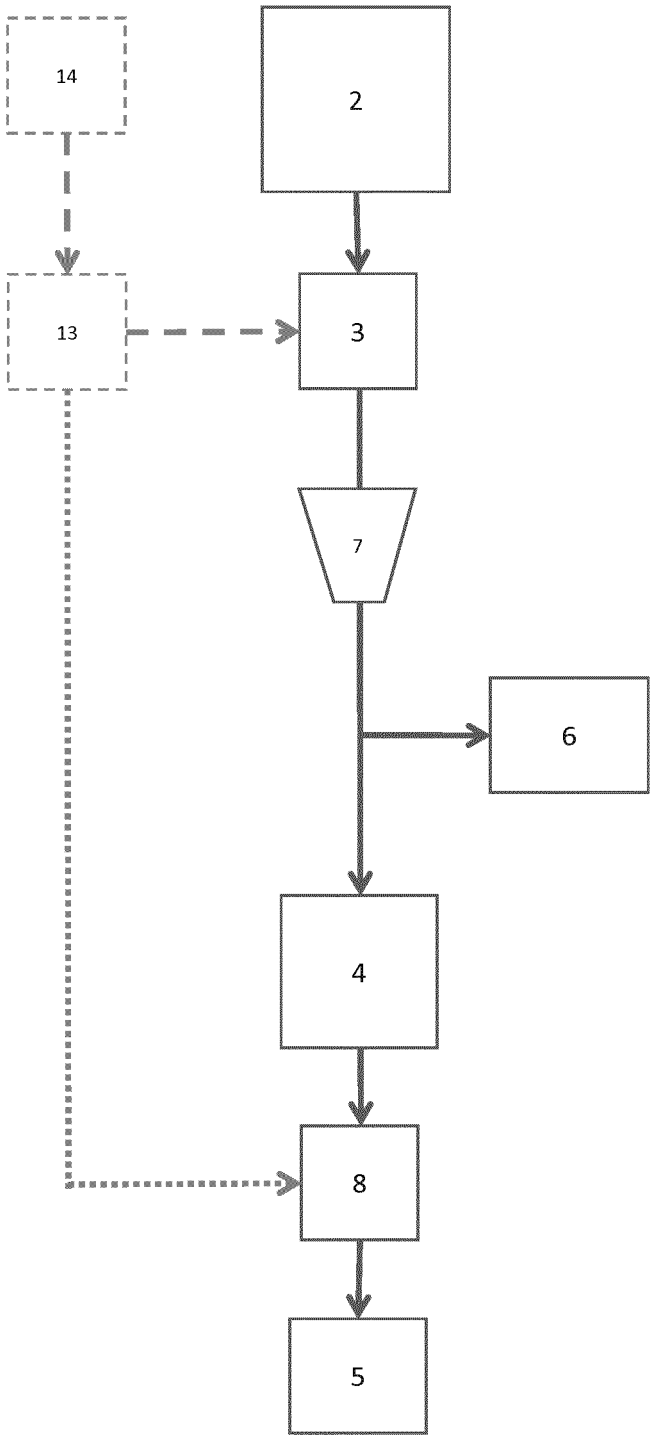
FIG. 1 shows a cleaning device with a compensating tank arranged in a branch.

In an embodiment, the present invention provides a cleaning device in which an undesired exit of steam from the cleaning head can be prevented.

In an embodiment of the present invention, a compensating device is arranged between the pump and the heating element. During the cleaning process, liquid is conveyed out of the liquid container in the direction of the heating element by means of the pump, wherein the liquid vaporizes and expands due to the vaporization and finally exits via the cleaning head in the direction of the surface to be cleaned. The compensating device makes it possible for residual water and steam to be stored in the cleaning device if an exit of steam from the cleaning device is not desired.

A first non-return valve can be arranged between pump and heating element, wherein the compensating device is arranged between the first non-return valve and the heating element. The first non-return valve can prevent residual water and steam, which has been created in the heating element, from flowing back into the pump or into the liquid container. The steam created in the heating element can therefore only exit from the cleaning head. However, the option of storing steam results due to the compensating device arranged in the flow direction downstream of the first non-return valve. As a result, it is possible to prevent an impermissibly high pressure from being created.

A first switchable valve can be arranged between heating element and cleaning head. The first switchable valve optionally makes it possible to allow through or block steam in the direction of the cleaning head. In this case, the first switchable valve can interact with a switching device for actuating the pump. The first switchable valve interrupts the connection between heating element and cleaning head, so that no steam can exit from the cleaning device if this is not desired.

It is possible that residual water remains in the heating element when the energy supply of the pump is interrupted. As a result, steam is still produced for a time even after switching off. In this case, the first switchable valve prevents this subsequently created steam from exiting from the cleaning head. The first non-return valve prevents steam from flowing in the direction of the liquid container. The compensating device arranged between the first non-return valve and the first switchable valve in this case prevents an impermissible high pressure from building up between the two valves owing to the steam which is backed up. The compensating device is used as a reservoir for the residual water pushed out from the heating element. Due to the increasing of pressure residual water will be flow into the compensating device.

The liquid container, the pump, the heating element, the first non-return valve, the switchable valve and the cleaning head can be connected to one another in each case by means of a fluid-conducting connection. A simple fluid-conducting connection in this case is a hose connection, for example by means of plastic hoses, particularly silicone hoses.

The compensating device can be incorporated into the fluid-conducting connection via a branch. To this end, a T-piece can for example be incorporated into the fluid-conducting connection, by means of which the compensating device is incorporated into the fluid-conducting connection.

The compensating device can have a fluid inlet and a fluid outlet. In this embodiment, the compensating device can be incorporated into the fluid-conducting connection in such a manner, that liquid or steam always flows through the compensating device. As a result, fluid exchange always takes place during operation, which is advantageous with respect to hygiene.

The compensating device can be embodied as a compensating tank. The compensating tank can be constructed as a membrane expansion vessel. In this case, the compensating tank has a volume, which is divided by means of a separating element, for example an elastic membrane, into two chambers, wherein the first chamber accommodates fluid and the second chamber constitutes a displacement volume. In a simple embodiment, the compensating tank merely provides an expansion volume. In this case, fluid can flow into the compensating tank and there comes into contact with the gas located in the compensating tank. In case the compensating tank is incorporated into the fluid-conducting connection via a branch, the compensating tank only contains one opening, through which steam can flow into the compensating tank and escape from the compensating tank. In case the compensation tank has a fluid inlet and a fluid outlet, the compensating device can be incorporated into the fluid-conducting connection in such a manner, that liquid or steam always flows through the compensating tank. As a result, fluid exchange always takes place during operation, which is advantageous with respect to hygiene.

A second non-return valve and a third non-return valve can be arranged between the compensating tank and the heating element, wherein the second non-return valve and the third non-return valve are incorporated into the fluid-conducting connection in parallel and oppositely orientated with respect to one another. In this embodiment, the second non-return valve allows steam to flow through in the direction of the first switchable valve or cleaning head. By contrast, the third non-return valve allows steam to flow back in the direction of the heating element or compensating tank if the first switchable valve is closed. In this case, the second non-return valve can be constructed in such a manner that it only allows fluid through if the pump pressure and the fluid accommodated in the compensating tank exceed a predetermined pressure. An even steam flow results and pulsing steam output can be prevented. The third non-return valve is preferably constructed in such a manner that backflow of fluid in the direction of the compensating tank is only possible if a predetermined pressure is exceeded. As a result, it is ensured that a certain pressure is maintained in the heating element and an even steam pressure results.

A second switchable valve can be arranged between the third non-return valve and the compensating tank. In this case, the second switchable valve can be constructed as a 2/2-way valve. A backflow of steam into the compensating tank is only then enabled by means of the additional second switchable valve if this is desired. In this case, the second switchable valve can interact with the first switchable valve and the pump, and for example be confirmed by means of a common switch or by means of a control unit.

A third switchable valve can be arranged between the second non-return valve, third non-return valve and compensating tank. In this case, the third switchable valve can be constructed as a 3/2-way valve. The third switchable valve optionally allows an inflow and outflow of fluid between the compensating tank and heating element.

The compensating device can be embodied as reverse flow, wherein the reverse flow comprises a duct connecting the liquid container. According to this embodiment the liquid container functions as an expansion chamber. The liquid container shall have an air cushion forming a compensating volume for the reverse flow. The air cushion can be realized by a dead volume, a balloon or a foam.

The reverse flow can be incorporated into the fluid-connecting connection via a branch, wherein the reverse flow comprises a second 2/2-way valve and a fourth non-return valve. The second 2/2-way valve opens the reverse flow when the switchable valve is closed. The fluid under pressure in the heating element flows through the reverse flow into the liquid container. Due to the exchange with the liquid in the liquid container, the fluid can at least partially condense.

The reverse flow can comprise a second 3/2-way valve and a fourth non-return valve, wherein the second 3/2-way valve is arranged between the first non-return valve and the heating element. The second 3/2-way valve connects the pump with the heating element, when the cleaning device is in use. When the use is interrupted, the connection between pump and heating element is closed and the reverse flow is opened.

The figures show a cleaning device 1, preferably for cleaning surfaces. The cleaning device 1 is formed as a handheld device. The cleaning device 1 comprises a base body, in which a liquid container 2 and a pump 3 for conveying liquid out of the liquid container 2 in the direction of a heating element 4 are accommodated. The cleaning device 1 further comprises a cleaning head 5, which faces in the direction of the surface to be cleaned and out of which the liquid vaporized in the heating element 4 exits. On the side opposite the cleaning head 5, the base body is provided with a handle, by means of which the cleaning device 1 can be holded over surfaces to be cleaned. A switch 14 is arranged in the handle, by means of which the pump 3 and the heating element 4 as well as further electrically switchable components of the cleaning device can be actuated. The heating element 4 comprises an electrical resistance heater, which is constructed in such a manner that the liquid vaporizes at least to some extent. The power supply is provided by an external power supply.

In order to limit the amount of water in the heating element 4, the heating element 4 has only limited capacity. To achieve this, the heating element 4 is provided with a unique fluid passage between inlet and outlet. Preferably, the fluid passage is formed as a tube which can be U-shaped. Due to this shape water will flow back into the liquid container 2 in case the pressure within the tube rises too high.

The cleaning head 5 can additionally be provided with means, so that the vaporized liquid which has impinged on the surface can be reabsorbed. The means preferably comprise textile material, for example in the form of a wiping cover. The cleaning head 5 can be provided with a direct steam outlet, with brushes, with flat supports and/or with a holder for reabsorbing material.

The base body furthermore accommodates a control unit 13, which is operatively connected to the switch 14 and the other electrical components and controls the pump 3 and the valves after the actuation of the switch 14, so that steam is generated, which impinges onto the surface to be cleaned via the cleaning head 5.

FIG. 1 shows a cleaning device 1, comprising a liquid container 2, a pump 3 for conveying liquid out of the liquid container 2 in the direction of a heating element 4, wherein the heating element 4 is set up to at least partially vaporize the liquid, wherein the heating element 4 is connected to a cleaning head 5, from which the vaporized liquid exits, wherein a compensating tank 6 is arranged between pump 3 and heating element 4.

A first non-return valve 7 is arranged between pump 3 and heating element 4, wherein the compensating tank 6 is arranged between the first non-return valve 7 and heating element 4. A first switchable valve 8 is arranged between the heating element 4 and cleaning head 5.

The liquid container 2, the pump 3, the heating element 4, the first non-return valve 7, the first switchable valve 8 and the cleaning head 5 are connected to one another in each case by means of a fluid-conducting connection in the form of a plastic hose. The compensating tank 6 is incorporated into the fluid-conducting connection via a branch, wherein the liquid flows into and flows out of the compensating tank 6 via the branch.

The pump 3 and the first switchable valve 8 are controlled via a control unit 13, wherein the control unit 13 is in turn actuated via the switch 14 arranged in the handle.

Figure 2:
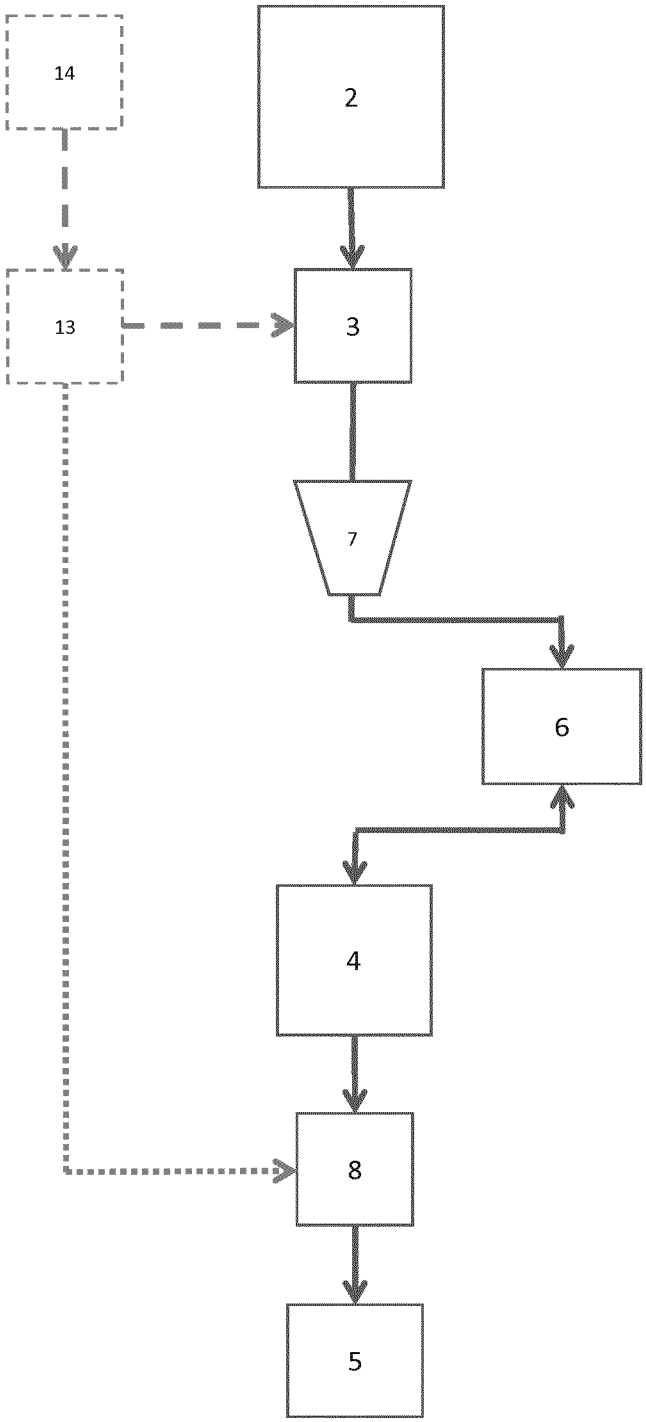

FIG. 2 shows a cleaning device according to FIG. 1, wherein the compensating tank 6 is constructed in such a manner that the compensating tank has a fluid inlet and a fluid outlet. In this respect, fluid always flows through the compensating tank 6.

Figure 3:
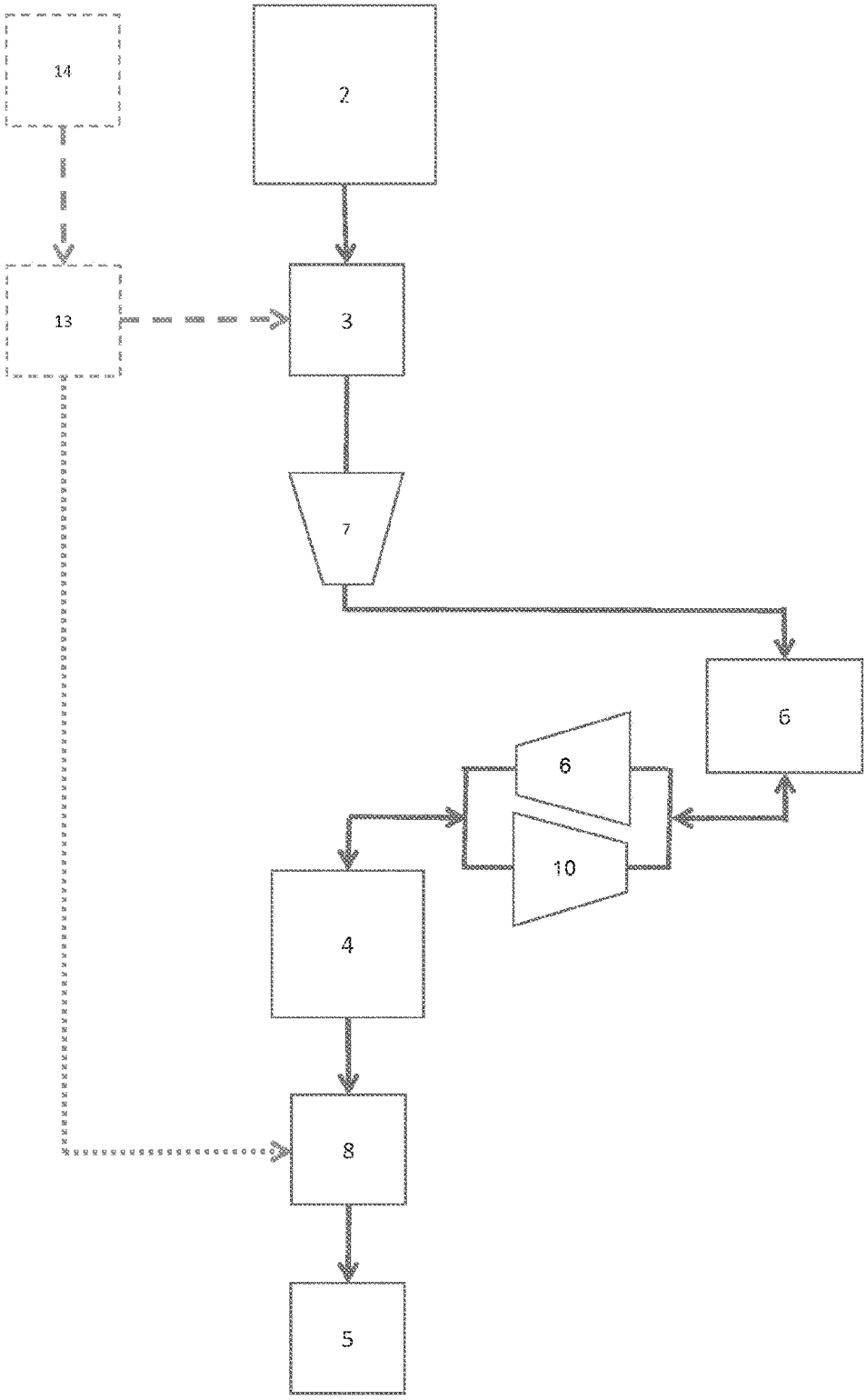
FIG. 3 shows a cleaning device a with a parallel connection of non-return valves.

FIG. 3 shows a development of the cleaning device according to FIG. 2, wherein a second non-return valve 9 and a third non-return valve 10 are arranged between compensating tank 6 and heating element 4, wherein the second non-return valve 9 and the third non-return valve 10 are incorporated into the fluid-conducting connection parallel to one another. The second non-return valve 9 allows fluid to flow through from the compensating tank 6 in the direction of the heating element 4. The third non-return valve 10 allows a backflow of fluid from the heating element 4 in the direction of the compensating tank 6. The second non-return valve 9 is in this case constructed in such a manner that it allows fluid through in the direction of the heating element 4 with a defined minimum pressure. The third non-return valve 10 is constructed in such a manner that it allows fluid through in the direction of the compensating tank 6 with a defined minimum pressure.

Figure 4:
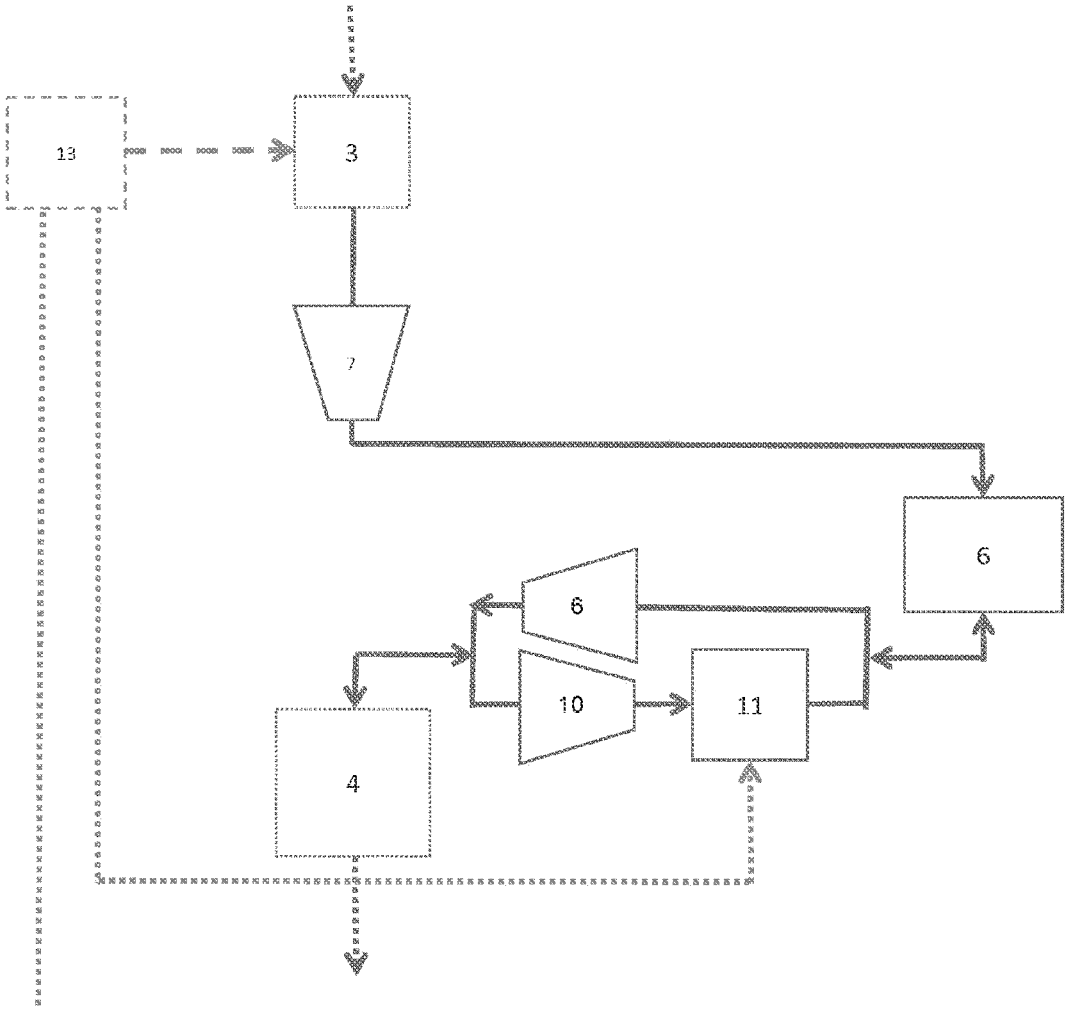
FIG. 4 shows a cleaning device with a parallel connection of non-return valves and an additional switchable valve.

FIG. 4 shows a development of the cleaning device according to FIG. 3, wherein a second switchable valve 11 in the form of a 2/2-way valve is arranged between third non-return valve 9 and compensating tank 6. The second switchable valve 11 opens the way back to the compensating tank 6 when the control unit 13 closes the switchable valve 8. The second switchable valve 11 is controlled by means of the control unit 13.

Figure 5:
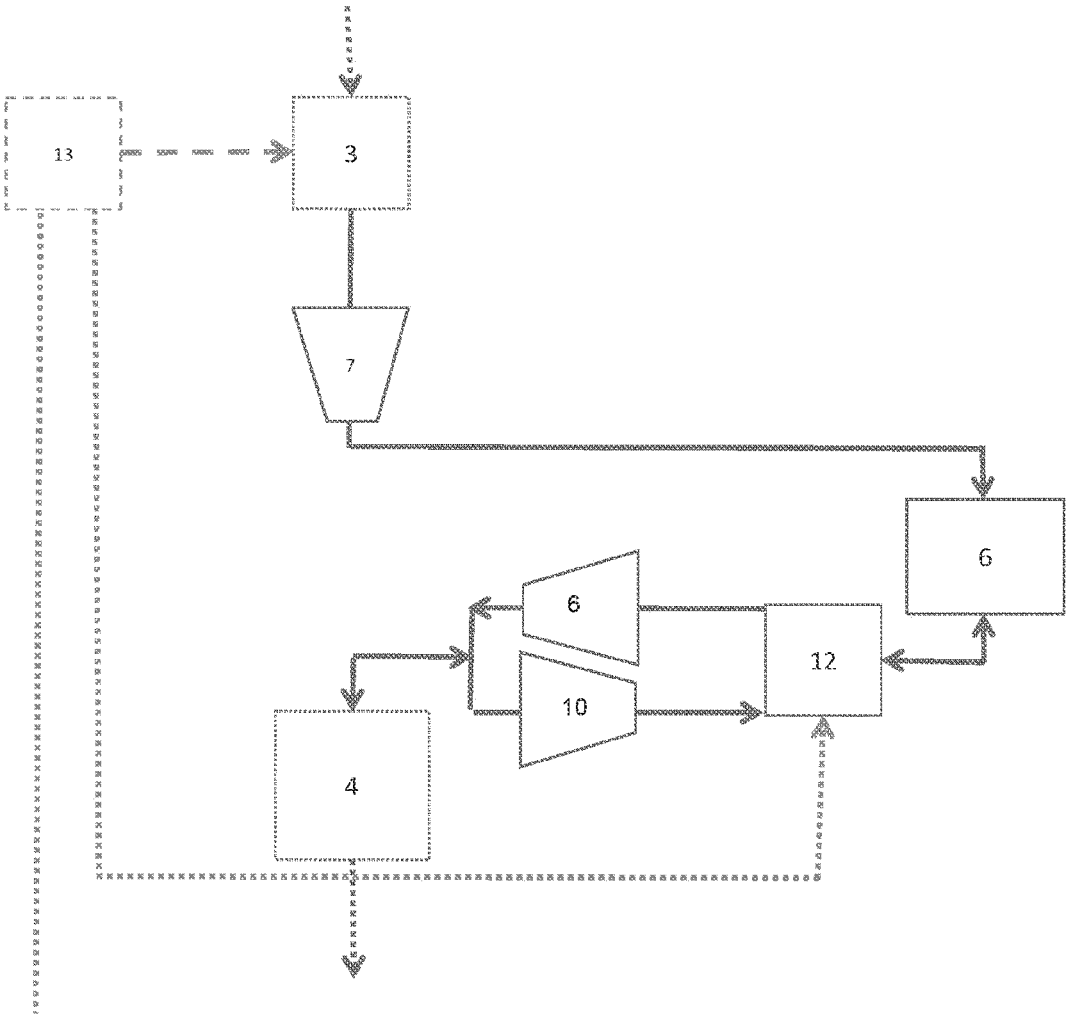
FIG. 5 shows a cleaning device with a parallel connection of non-return valves and a switchable valve arranged between non-return valves and compensating tank.

FIG. 5 shows a development of the cleaning device according to FIG. 3, wherein a third switchable valve 12 in the form of a 3/2-way valve is arranged between the second non-return valve 9, third non-return valve 10 and compensating tank 6. The valve 12 controls the fluid direction in relation to the status of valve 8. The third switchable valve 12 is controlled by means of the control unit 13.

Figure 6:
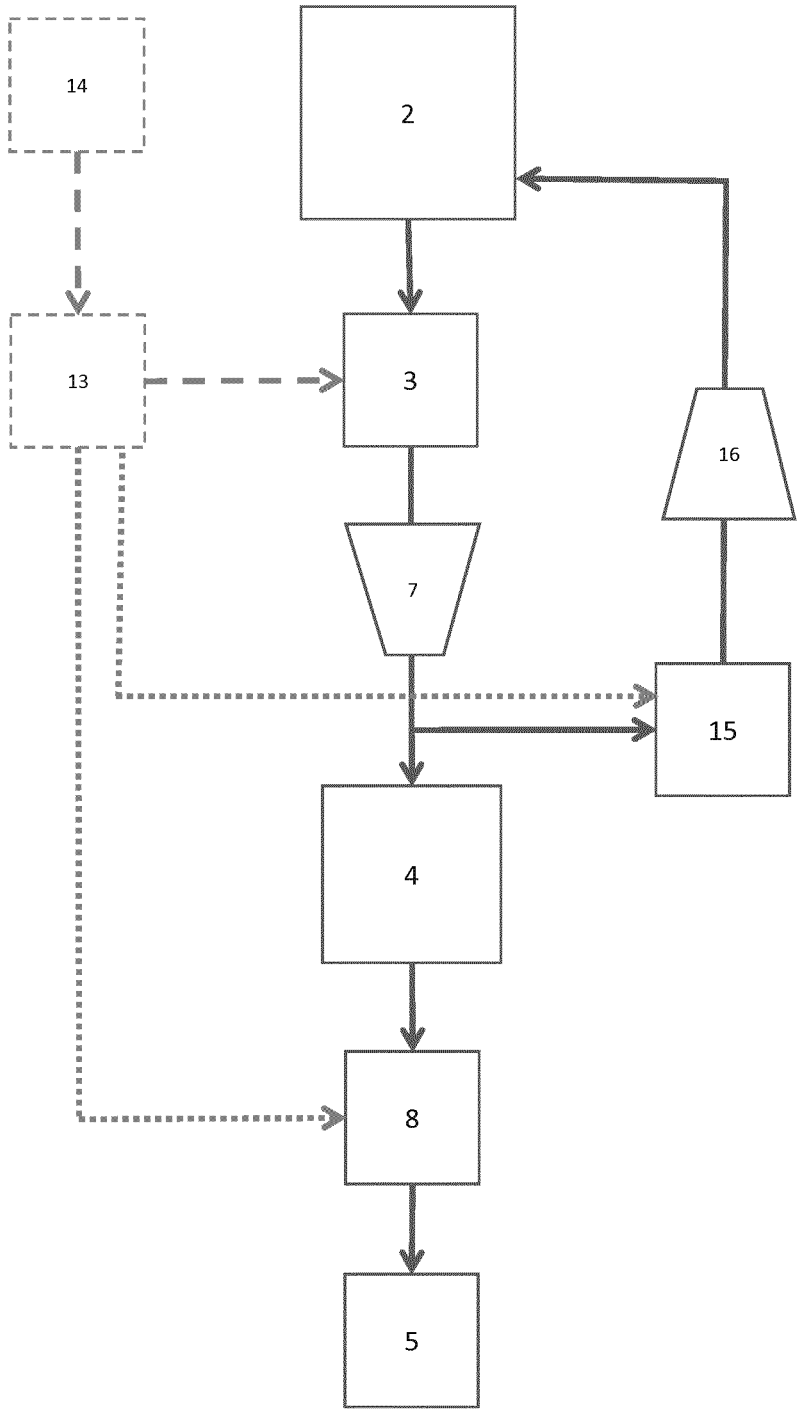
FIG. 6 shows a cleaning device with a reverse flow arranged in a branch.

FIG. 6 shows a cleaning device 1, comprising a liquid container 2, a pump 3 for conveying liquid out of the liquid container 2 in the direction of a heating element 4, wherein the heating element 4 is set up to at least partially vaporize the liquid, wherein the heating element 4 is connected to a cleaning head 5, from which the vaporized liquid exits, wherein the compensating device in form of a reverse flow is arranged between pump 3 and heating element 4.

A first non-return valve 7 is arranged between pump 3 and heating element 4, wherein the reverse flow is arranged between the first non-return valve 7 and heating element 4. A first switchable valve 8 is arranged between the heating element 4 and cleaning head 5.

The liquid container 2, the pump 3, the heating element 4, the first non-return valve 7, the first switchable valve 8 and the cleaning head 5 are connected to one another in each case by means of a fluid-conducting connection in the form of a plastic hose. The reverse flow is incorporated into the fluid-conducting connection via a branch, wherein the liquid flows into and flows out of the compensating tank 6 via the branch. The reverse flow comprises a second 2/2-way valve 15 and a fourth non-return valve 16. The second 2/2-way valve is integrated in the duct between the first non-return valve 7 and the heating element 7. The fourth non-return valve 16 prevents that liquid from the liquid container 2 flows through the reverse flow The pump 3 and the first switchable valve 8 are controlled via a control unit 13, wherein the control unit 13 is in turn actuated via the switch 14 arranged in the handle.

Figure 7:
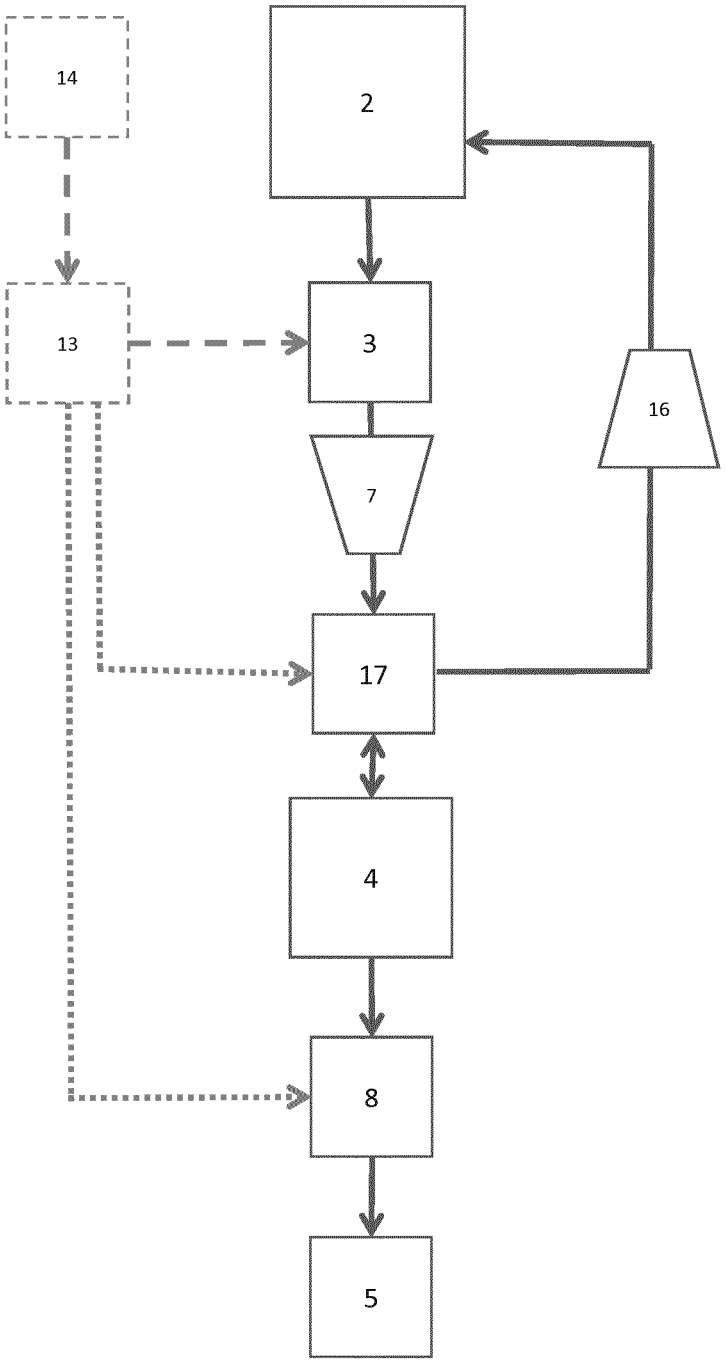
FIG. 7 shows a cleaning device with a reverse flow with the 3/2-way valve.

FIG. 7 shows a cleaning device 1 according to FIG. 6. The reverse flow of the embodiment according to FIG. 6 is connected via a second 3/2-way valve 17, which is integrated in the duct between the first non-return valve 7 and the heating element 7.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A cleaning device, comprising:

a liquid container;

a heating element; and a pump configured to convey liquid out of the liquid container in a direction of the heating element, wherein the heating element is configured to at least partially vaporize the liquid, the heating element being connected to a cleaning head, from which the vaporized liquid exits, wherein a compensating device is arranged between the pump and the heating element, and wherein the compensating device is configured to store water and steam.

2. The cleaning device according to claim 1, wherein a first non-return valve is arranged between the pump and the heating element, wherein the compensating device comprises a compensating tank, and wherein the compensating tank is arranged between the first non-return valve and the heating element.

3. The cleaning device according to claim 2, wherein a first switchable valve is arranged between the heating element and the cleaning head.

4. The cleaning device according to claim 3, wherein the fluid container, the pump, the heating element, the first non-return valve, the switchable valve, and the cleaning head are connected to one another in each case by a fluid-conducting connection.

5. The cleaning device according to claim 4, wherein the compensating tank is incorporated into the fluid-conducting connection via a branch.

6. The cleaning device according to claim 1, wherein the compensating device has a fluid inlet and a fluid outlet.

7. The cleaning device according to claim 4, wherein a second non-return valve and a third non-return valve are arranged between compensating tank and heating element, and wherein the second non-return valve and the third non-return valve are incorporated into the fluid-conducting connection in parallel and oppositely oriented with respect to one another.

8. The cleaning device according to claim 7, wherein a second switchable valve is arranged between the third non-return valve and the compensating tank.

9. The cleaning device according to claim 8, wherein the second switchable valve comprises a 2/2-way valve.

10. The cleaning device according to claim 8, wherein a third switchable valve is arranged between the second non-return valve, the third non-return valve, and the compensating tank.

11. The cleaning device according to claim 10, wherein the third switchable valve comprises a 3/2-way valve.

12. The cleaning device according to claim 1, wherein the compensating device comprises a reverse flow unit, and wherein the reverse flow unit comprises a duct connected to the liquid container.

13. The cleaning device according to claim 12, wherein the reverse flow unit is incorporated into a fluid-conducting connection via a branch, and wherein the reverse flow unit comprises a second 2/2-way valve and a fourth non-return valve.

14. The cleaning device according to claim 12, wherein the reverse flow unit comprises a second 3/2-way valve and a fourth non-return valve, and wherein the second 3/2-way valve is arranged between the first non-return valve and the heating element.

* * * * *